US006412707B1

(12) United States Patent
Wirz

(10) Patent No.: US 6,412,707 B1
(45) Date of Patent: Jul. 2, 2002

(54) COMPACT PORTABLE SPRAYER WITH LEAK-PREVENTION PUMP SYSTEM

(76) Inventor: Pedro Wirz, P.O. Box 151, Lagos de Moreno (MX), 47400

( * ) Notice: Subject to any disclaimer, the term of this patent is extended or adjusted under 35 U.S.C. 154(b) by 10 days.

(21) Appl. No.: 09/778,303

(22) Filed: Feb. 6, 2001

(51) Int. Cl.[7] ..... A62C 15/00

(52) U.S. Cl. ..... 239/154; 239/333; 222/175; 222/424; 222/529

(58) Field of Search ..... 239/142, 152–154, 239/127, 333, 373; 222/529, 530, 401, 383–385, 175, 424, 527

(56) References Cited

U.S. PATENT DOCUMENTS 4,798,333 A 1/1989 Luchsinger ..... 239/142

5,335,853 A 8/1994 Wirz ..... 239/142

*Primary Examiner*—Lisa A. Douglas
(74) *Attorney, Agent, or Firm*—Lyon & Lyon LLP

(57) ABSTRACT

A portable backpack sprayer for spraying liquid chemicals such as pesticides, fungicides, and fertilizers having a large storage tank in which is mounted a pressure vessel. A manually actuated pumping assembly is connected with the bottom portion of the pressure vessel and also with the bottom portion of the tank. The pumping assembly comprises a reciprocating piston to draw liquid from the storage tank and pressurize it within the pressure vessel. The operator may discharge the pressurized liquid using a hose and a control valve affixed to the pressure vessel. The pumping assembly further comprises a double-walled piston and a leak barrier to collect any liquid that may leak from the piston. The reciprocating action of the piston is utilized to return the leaked liquid to the storage tank via a return siphon.

5 Claims, 3 Drawing Sheets

COMPACT PORTABLE SPRAYER WITH LEAK-PREVENTION PUMP SYSTEM

BACKGROUND OF THE INVENTION

1. Field of the Invention

The field of the invention is backpack-type sprayers for spraying liquid under pressure.

2. Prior Art

Various United States patents have been obtained for hand-operated backpack-type sprayer combinations adapted to spray liquid chemicals such as insecticides, fertilizers, fungicides, etc. These include U.S. Pat. Nos. 4,690,331; 4,702,416; 4,702,419; 4,768,714; 4,798,333; and 5,335,853, each of which is incorporated herein by reference. The constructions shown and described in the specified patents, with the exception of U.S. Pat. No. 5,335,853, include relatively large-diameter diaphragms that are used to pump liquid from a storage tank to a pressurized container. The diaphragms are often combined with a piston such that the diaphragm-piston combination not only pumps and pressurizes the liquid, but also agitates and mixes the liquid in the bottom of the storage tank.

An important consideration for portable sprayers is leak prevention. As indicated above, the sprayers are frequently used to spray insecticides, fungicides, and fertilizers, all three of which may be hazardous to either the operator or the surroundings if not properly protected. Diaphragms are very good at sealing against leakage. However, after prolonged use in association with certain types of chemicals, even the best diaphragms may eventually fail. Upon occurrence of diaphragm failure, the chemicals within the sprayer tend to leak out the bottom of the structure and may come into contact with the operator or the surroundings.

The invention claimed in U.S. Pat. No. 5,335,853 replaces the diaphragm with a piston assembly in order to help reduce leakage. However, leakage may still occur through the piston assembly if portions of that assembly fail to operate as intended due to extended use or wear and tear. Regular preventive maintenance becomes necessary to replace parts of the sprayer before a failure, and the associated leakage, can occur. A sprayer capable of protecting against leakage when such failure occurs is therefore desirable.

SUMMARY OF THE INVENTION

In accordance with the present invention, a compact, strong, long-lasting portable sprayer having a piston assembly which protects against leakage is disclosed. The piston has a double-walled construction, which in conjunction with the piston cylinder define a primary leak collection chamber. Liquid leaking from the piston assembly is collected in the primary chamber and expelled into a secondary leak collection chamber by the reciprocating action of the piston. The secondary collection chamber is defined by affixing a leak barrier, preferably an expandable bellows, to both the piston and the pressure vessel. Once in the secondary chamber, liquid may be pumped into the tank through a siphon by the reciprocating action of the piston. In returning the liquid to the storage tank, the siphon disperses liquid in an upper interior portion of the tank so that the reciprocating action does not pump liquid from the tank through the siphon.

In an alternative embodiment, a one-way valve may be placed on the siphon so that liquid may not be pumped from the tank through the siphon.

DETAILED DESCRIPTION OF THE PREFERRED EMBODIMENT

Figure 1:
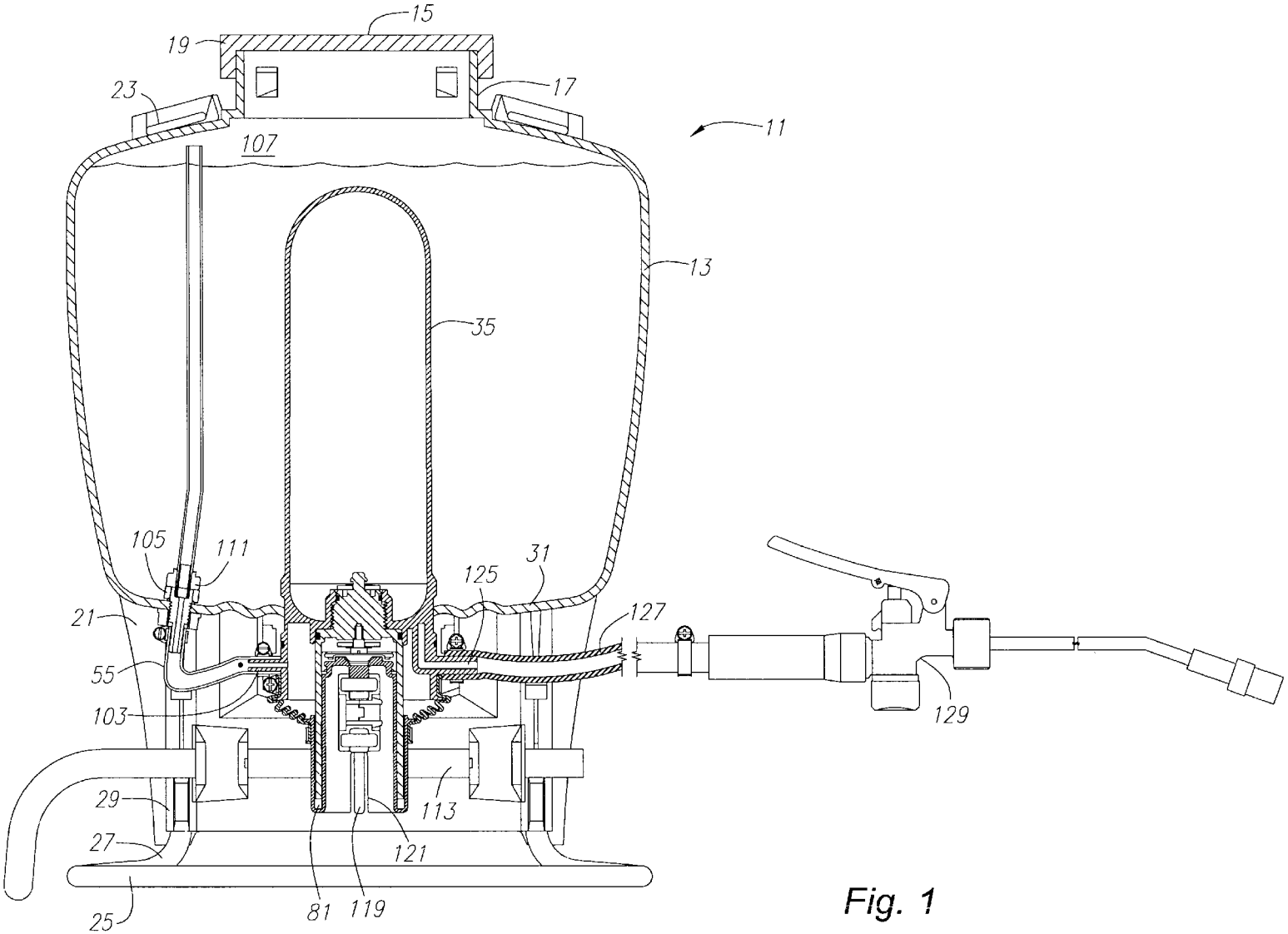
FIG. 1 is a rear sectional view of a preferred embodiment of the invention.

Referring now to the drawings, FIG. 1 illustrates a preferred embodiment of a portable sprayer 11. The portable sprayer comprises a liquid storage tank 13 preferably constructed using a synthetic resin, or other similarly light weight and durable materials, and having a substantially flat backside (not shown) adapted to rest against the back of an operator carrying and operating the sprayer 11. The storage tank 13 may be filled with liquid chemicals, such as insecticides, fungicides, fertilizers, etc., through a large fill opening 15 defined by a neck 17. Once the storage tank 13 is full and ready for use, a screw-type cap 19 preferably seals the fill opening 15.

The bottom-rear portion of the storage tank 13 has an integrally molded support structure 21, the back of which is substantially co-planar with the back side of the storage tank 13 so that the entire structure may rest against the back of an operator. Strong apertures 23 are formed at the upper-rear portion of the storage tank 13 to support shoulder straps, not shown, that extend over the shoulders and then downwardly for securing to a support frame 25 that is disposed in a generally horizontal plane. The ends of the support frame 25 are bent upwardly to form legs 27 that are anchored fixedly in vertical bosses 29 of the support structure 21.

Figure 2:
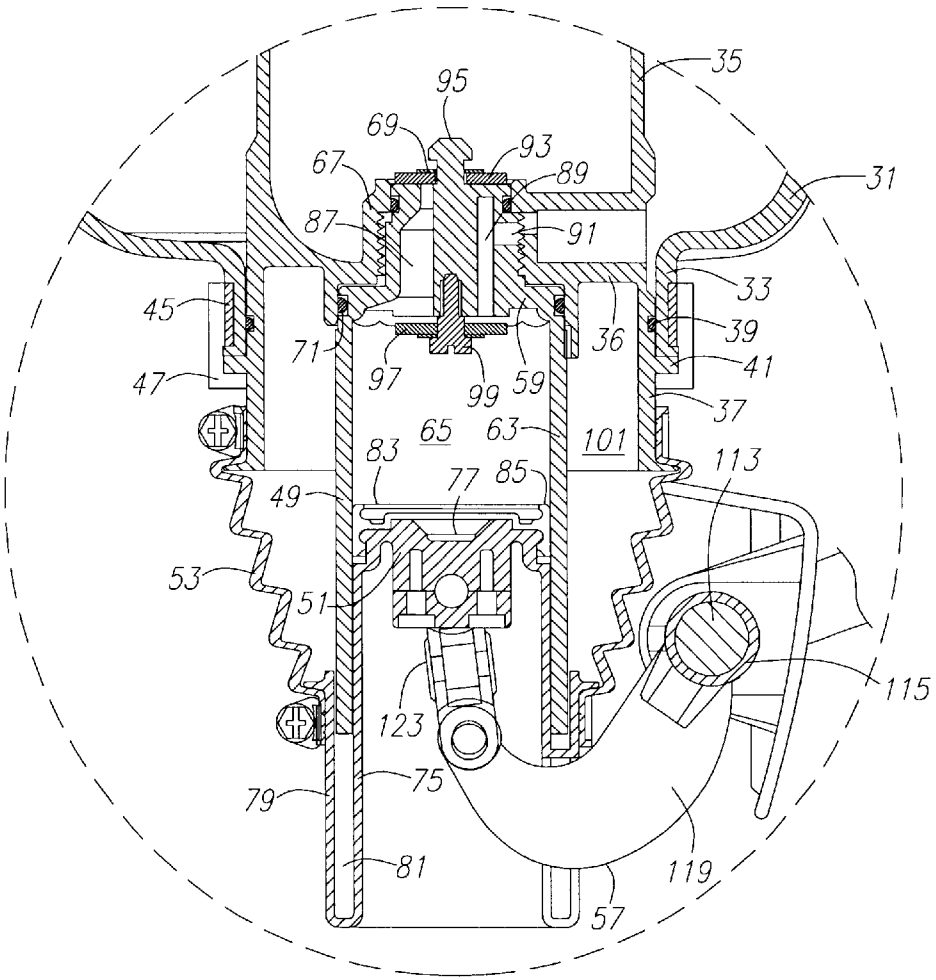
FIG. 2 is a detailed sectional view of a portion of the apparatus of FIG. 1.

Referring next to FIG. 2 as well as FIG. 1, the bottom wall 31 of the storage tank 13 is generally horizontal and has a relatively large vessel opening defined by a downwardly-bent cylindrical flange 33 extending from the bottom wall 31. A vertically elongated pressure vessel is inserted through the vessel opening, extending into the interior of the storage tank 13. The pressure vessel 35 is constructed of a strong material, preferably synthetic resin, which is capable of withstanding pressures created therein by operation of the pump as described below.

The bottom portion of the pressure vessel 35 comprises an exteriorly cylindrical end 37 which fits closely against the interior cylindrical surface of the flange 33. The cylindrical end 37 comprises a first annular groove 39 integrated into the outer surface of the cylindrical end 37 and a radial end flange 41. An O-ring is placed into the first annular groove 39 to provide a seal between the cylindrical end 37 and the flange 33. When the pressure vessel 35 is inserted into the storage tank 13, the radial end flange 41 rests against the flange 33 to prevent the pressure vessel 35 from sliding further into the storage tank 13. The pressure vessel 35 is held firmly in place and the seal between the cylindrical end 37 and the flange 33 is strengthened by the application of appropriate mechanical pressure, such as through the use of a large diameter hose clamp 45 mounted and tightened around the flange 33 and the pressure vessel 35. Circumferentially-spaced lugs 47 (shown in FIG. 2) may be attached to the clamp 45, the lugs 47 extending around the radial end flange 41 and, in combination with the clamp 45, immobilizing the pressure vessel 35 in relation to the storage tank 13.

As is illustrated in FIG. 2, a pump assembly is disposed at the bottom wall 36 of the pressure vessel 35 within the cylindrical end 37. The pump assembly chiefly comprises a pump cylinder 49, a reciprocating piston 51, a leak barrier 53, a return siphon 55, and a piston crank 57. The pump cylinder 49, preferably constructed using a synthetic resin material, comprises an enclosed top end 59 which extends through the bottom wall 36 and into the pressure vessel 35 and an open bottom end 61 with a cylinder wall 63 which defines a smooth-walled piston chamber 65. The overall length of the cylinder wall 63 is preferably at least twice the total linear displacement of the piston 51 during operation as herein described. The top end 59 has exterior threads which are threadedly associated with interior threads of an internally extending boss portion 67 of the pressure vessel 35. The pressure vessel 35 is sealed against leakage by O-rings placed in two annular grooves 69, 71 formed in the top end 59 of the pump cylinder 49. The first annular groove 69 is positioned such that a seal is created between the boss portion 67 and the top end 59, and the second annular groove 71 is positioned such that a seal is created between the top end 59 and a cylindrical flange extending from the pressure vessel 35.

The piston 51, preferably constructed using a synthetic resin material, comprises an inner wall 75 having an integral piston head 77 at one end and at the other end the inner wall 75 folds back upon itself to form an outer wall 79. The piston head 77 and the inner wall 75 are disposed within the piston chamber 65 and the outer wall 79 is disposed outside the piston chamber 65, such that the cylinder wall 63 is disposed between the inner and outer walls 75, 79. The combination of the cylinder wall 63, the inner wall 75, and the outer wall 79 defines a primary leak collection chamber 81 which collects any liquid that may leak from the piston. During operation, the piston reciprocates between a first position, illustrated in FIG. 1, wherein the piston head 77 is disposed adjacent to the top end 59 of the piston chamber 65 and a second position, illustrated in FIG. 2, wherein the piston head 77 is linearly displaced away from the top end 59 of the piston chamber 65.

A fustoconical piston cup 83 formed of a suitable flexible and preferably resilient sealing (not porous) material is disposed over the piston head 77. The piston cup 83 has a sealing edge 85 that is held against the cylinder wall 63 by the resilience of the cup 83 and by the pressure within the piston chamber 65. When the piston 51 moves towards the top end 59 of the pump cylinder 49, hereinafter the "upstroke", pressure in the piston chamber 65 is increased and the upper sealing edge 85 is held more tightly against the cylinder wall 63. When the piston 51 moves away from the top end 59 of the pump cylinder 49, hereinafter the "downstroke", pressure in the piston chamber 65 is reduced.

The top end 59 of the piston 51 further comprises an outlet passage 87 which permits liquid to flow between the piston chamber 65 and the pressure vessel 35 and an inlet passage 89 which, in combination with an inlet notch 91 in the pressure vessel 35, permits liquid to flow between the storage tank 13 and the piston chamber 65. A first flexible valve disc 93 is mounted on a knob 95 that is integral to the exterior top end 59 of the pump cylinder 49 such that the first disc 93 is disposed over the end of the outlet passage 87. A second flexible valve disc 97 is mounted on the top end 59 within the piston chamber 65, such that the second disc 97 is disposed over the opening of the inlet passage 89. The second disc 97 is held in place by a screw 99 that is threaded into the top end 59 of the pump cylinder 49.

When the piston 51 is on the downstroke, the decreased pressure in the piston chamber 65 will draw liquid from the storage tank 13, through the inlet passage 89, and into the piston chamber 65, but because of the decreased pressure in the piston chamber 65, the first disc 93 will block the outlet passage 87 and no liquid will flow into the piston chamber 65 from the pressure vessel 35. When the piston 51 is on the upstroke, the increased pressure in the piston chamber 65 will force liquid from the piston chamber 65, through the outlet passage 87, and into the pressure vessel 35, but because of the increased pressure in the piston chamber 65, the second disc 97 will block the inlet passage 89 and no liquid will flow into the storage tank 13 from the piston chamber 65. Therefore, through repeated upstrokes and downstrokes of the reciprocating piston 51, liquid will be pumped from the storage tank 13 and pressurized within the pressure vessel 35.

Figure 3:
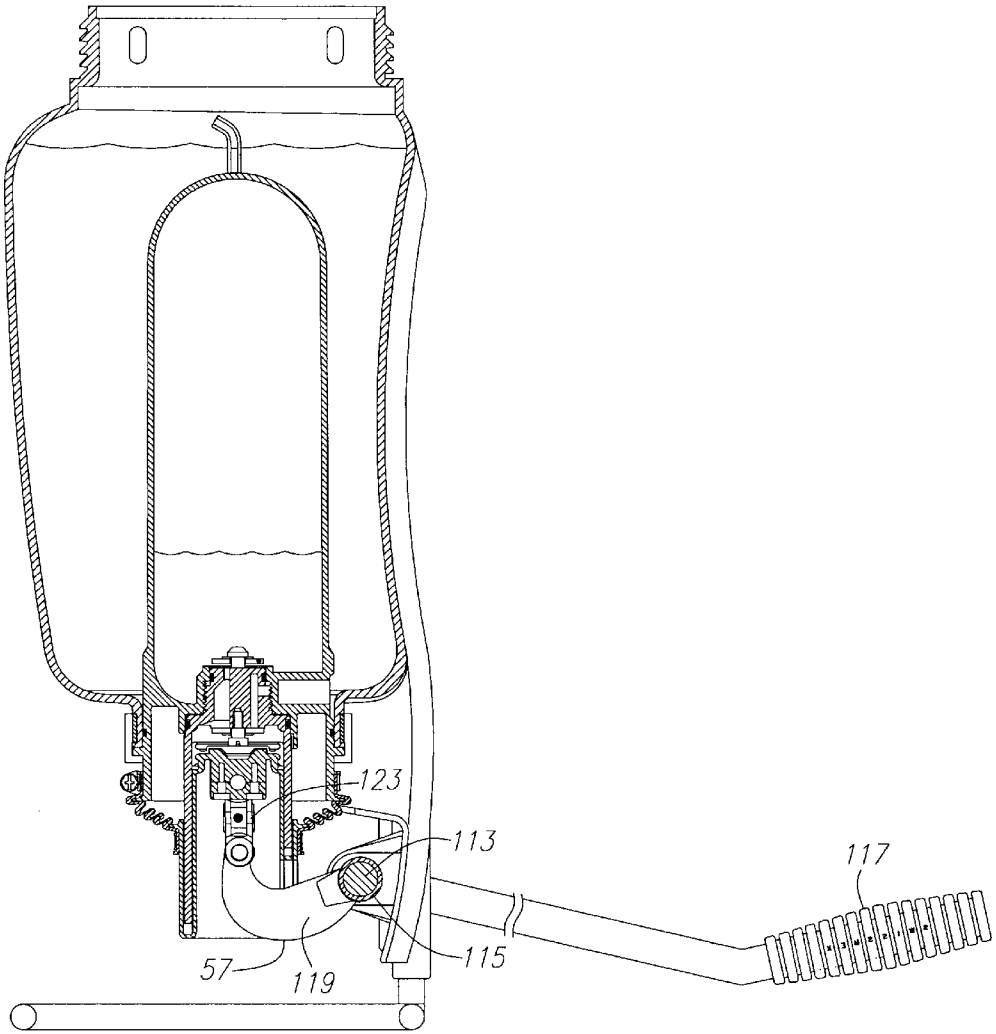
FIG. 3 is a side sectional view of the apparatus of FIG. 1.

The leak barrier 53 portion of the pump assembly preferably comprises a suitably flexible and resilient material and is illustrated in FIG. 2 as an extendible conical bellows. Preferably, the bellows is constructed using rubber that is weather and chemical resistant. Such an extendible bellows reduces and nearly eliminates stress on the leak barrier 53 due to repeated extensions and contractions during piston 51 reciprocation. As shown in FIG. 2, one end of the bellows is sealingly affixed to the outer wall 79 of the piston 51 and the opposite end is sealingly affixed to the cylindrical end 37 of the pressure vessel 35. A secondary leak collection chamber 101 is thereby defined by the bellows, the piston 51, and the pressure vessel 35. Attached thusly, when the piston 51 is on the downstroke, the volume of the secondary chamber 101 is expanded, with the maximum volume occurring at the end of the downstroke. FIG. 2 illustrates the secondary chamber 101 at a point of maximum volume. Conversely, when the piston 51 is on the upstroke, the volume of the secondary chamber 101 is reduced, with the minimum volume occurring at the end of the upstroke. FIG. 3 illustrates secondary chamber 101 at a point of minimum volume.

The return siphon 55 is sealingly affixed to the secondary collection chamber 101 via a siphon duct 103. The return siphon 55 passes through a sealing connector 105 in the bottom wall 31 of the storage tank 13 and extends to an upper interior portion 107 of the storage tank 13 where the siphon 55 opens up into the storage tank 13. Between the sealing connector 105 and the secondary collection chamber 101, the siphon 55 is preferably either a flexible hose or a rigid tube. Within the storage tank 13, the siphon 55 is preferably a rigid tube to ensure that the open end remains in the upper interior portion 107 of the storage tank 13 because if the siphon is submersed in the liquid stored in the storage tank 13, the reciprocating action of the piston 51 will cause liquid to be drawn from the storage tank 13, through the siphon 55, and into the secondary collection chamber 101. In an alternative embodiment, a the siphon 55 may additionally comprise a one way flow valve 111, such as those commonly known in the art, to prevent water from being drawn out of the storage tank 13 and into the secondary collection chamber 101.

In the event of leakage from the piston 51, liquid will first collect in the primary collection chamber 81. The reciprocating action of the piston 51 will pump liquid from the primary collection chamber 81 and into the secondary collection chamber 101. During the downstroke, the volume of the primary collection chamber 81 is expanded by the downward motion of the inner and outer walls 75, 79, thus filling the primary collection chamber 81 with any liquid that leaks from the piston chamber 65. During the upstroke, the upward motion of the inner and outer walls 75, 79 reduces the volume of the primary collection chamber 81, expelling liquid out of the primary collection chamber 81 and into the secondary leak chamber 101. Liquid accumulates within the secondary chamber 101 until the volume of liquid is at least equal to the minimum volume of the secondary chamber 101 at the end of the upstroke. As liquid continues to leak and the volume of liquid in the secondary chamber 101 exceeds the minimum volume of the secondary chamber 101, the reciprocating action of the piston 51 causes the bellows to pump liquid through the siphon 55 and back into the storage tank 13. In this manner, liquid from a leaking piston is prevented from falling on the operator or the surroundings.

As illustrated in FIGS. 1 and 3, the piston crank portion of the pump assembly effects the reciprocation action of the piston and comprises a horizontal rotatable cross-member 113 integrally mounted to the support structure 21 using bearings 115. The cross-member 113 connects to a handle 117 which may be used by the operator with great mechanical advantage to rotate the cross-member 113 and reciprocate the piston 51. A bellcrank 119 is fixedly mounted on the cross-member 113 such that the bellcrank 119 is centered upon the piston 51. The bellcrank 119 attaches to the center of the piston 51 by passing through a slot 121 in the inner and outer walls 75, 79, which are appropriately connected to maintain the integrity of the primary collection chamber 81, and the cylinder wall 63, as illustrated in FIG. 1. The slot 121 is preferably no longer than the total linear displacement of the piston 51 during reciprocation.

Returning to FIG. 2, the bellcrank 119 is preferably pivotally connected to an extender 123 which is in turn pivotally connected to the piston 51. The dual pivot connection between the bellcrank 119, the extender 123, and the piston 51 permits flexibility in precisely where the cross-member 113 is mounted to the support structure 21. Such flexibility substantially prevents the piston 51 from binding with the piston chamber 65 during reciprocation.

Referring again to FIG. 1, once the liquid is pressurized within the pressure vessel 35, it may be discharged through a pressure outlet 125 in the cylindrical end 37 of the pressure vessel 35. The pressure outlet 125 is sealingly affixed to a hose 127 and a control valve 129 which may be used at the discretion of the operator to discharge pressurized liquid from the pressure vessel 35.

Thus, a compact portable sprayer with a leak prevention pump system is disclosed. While embodiments of this invention have been shown and described, it would be apparent to those skilled in the art that many more modifications are possible without departing from the inventive concepts herein. The invention, therefore, is not to be restricted except in the spirit of the appended claims.

What is claimed is:

1. A portable sprayer comprising:

a large liquid storage tank adapted to be carried on the back of an operator, said tank having a bottom wall, an upper interior portion, and a fill opening;

a pressure vessel mounted within the tank, said pressure vessel having a bottom portion sealingly affixed to a vessel opening in the bottom wall of the tank;

a pump assembly affixed to the bottom portion of the pressure vessel, said pump assembly comprising:

(a) a pump cylinder having a cylinder wall which defines a piston to chamber, (b) a reciprocating piston having a piston head, an inner wall, and an outer wall, said piston being slidably affixed to the cylinder wall such that the piston head and the inner wall are disposed within the piston chamber, wherein the piston head forms a seal against the cylinder wall and encloses the piston chamber, and the outer wall is disposed outside the piston chamber, the inner wall, the outer wall, and the cylinder wall thereby forming a primary leak collection chamber, (c) an inlet passage connecting the piston chamber to the tank and an outlet passage connecting the piston chamber to the pressure vessel, such that upon reciprocation of the piston, the pumping assembly pumps liquid from the tank to the pressure vessel, (d) a leak barrier sealingly affixed to the outer wall of the piston and to the bottom portion of the pressure vessel, thereby forming a secondary leak collection chamber which accumulates liquid overflow from the primary leak collection chamber, (e) a return siphon sealingly affixed to the bottom portion of the pressure vessel, said siphon passing through the bottom wall of the tank and extending to the upper interior portion of the tank such that upon reciprocation of the piston, the leak barrier may pump liquid collected in the secondary leak collection chamber through the siphon and into the upper interior portion of the tank, and (f) a piston crank pivotally attached to the piston, said piston crank being fixedly attached to a rotatable cross-member to effect reciprocation of the piston; and a hose having a first end sealingly affixed to the pressure vessel and a second end sealingly affixed to a control valve such that opening the control valve discharges pressurized liquid from the pressure vessel.

2. The portable sprayer of claim 1, wherein the leak barrier comprises an extendable bellows.

3. The portable sprayer of claim 1, wherein the siphon comprises a rigid tube.

4. The portable sprayer of claim 1, wherein the portion of the siphon disposed outside of the tank comprises a flexible hose and the portion of the siphon disposed within the tank comprises a rigid tube.

5. The portable sprayer of claim 1, wherein the siphon comprises a one way flow valve which permits liquid to be pumped into the tank through the siphon and prevents liquid from flowing out of the tank through the siphon.

* * * * *